US006684778B2

(12) United States Patent
Sasaki

(10) Patent No.: US 6,684,778 B2
(45) Date of Patent: Feb. 3, 2004

(54) PRINTING PRESS WITH A SHEET-TURNING-OVER-MECHANISM

(75) Inventor: Masamichi Sasaki, Fuchu (JP)

(73) Assignee: Ryobi, Ltd., Hiroshima-ken (JP)

( * ) Notice: Subject to any disclaimer, the term of this patent is extended or adjusted under 35 U.S.C. 154(b) by 0 days.

(21) Appl. No.: 10/155,355

(22) Filed: May 23, 2002

(65) Prior Publication Data

US 2002/0174785 A1 Nov. 28, 2002

(30) Foreign Application Priority Data

May 25, 2001 (JP) ..... 2001-157099

(51) Int. Cl.[7] ..... B41F 5/02
(52) U.S. Cl. ..... 101/229; 101/230; 101/231
(58) Field of Search ..... 101/229, 230, 101/231, 179, 220, 190, 254, 262, 289

(56) References Cited

U.S. PATENT DOCUMENTS 4,147,105 A * 4/1979 Becker ..... 101/230
4,279,523 A * 7/1981 Ringle ..... 400/279
4,530,283 A * 7/1985 Mathes et al. ..... 101/230
5,584,241 A * 12/1996 Yuasa ..... 101/230

FOREIGN PATENT DOCUMENTS

JP 04085041 A * 3/1992 ..... B41F/33/04

* cited by examiner

*Primary Examiner*—Andrew H. Hirshfeld
*Assistant Examiner*—Minh H. Chau
(74) *Attorney, Agent, or Firm*—Perkins Coie LLP; Paul L. Hickman; David B. Dort

(57) ABSTRACT

There is provided a printing press with a sheet-turning-over-mechanism for turning over a printing sheet, enabling the printing press to be selectively operable in a one-sided printing mode and a double-sided printing mode. The printing press includes a controller which, when any failure stops any one of steps of a mode switching operation for switching the printing press from the one-sided printing mode to the double-sided printing mode or vice versa, stores the information representative of a state of the mode switching operation at the moment of the stop due to the failure, and when a normal operable state is restored from the failure, resumes the mode switching operation from a step of the mode switching operation indicated by the operational state stored therein.

7 Claims, 11 Drawing Sheets

PRINTING PRESS WITH A SHEET-TURNING-OVER-MECHANISM

CROSS-REFERENCE TO RELATED APPLICATIONS

This Application claims priority under 35 USC §119 of Japanese Patent Application No. 2001-157099 filed on May 25, 2001, which is incorporated herein by reference in its entirety, and is related to Japanese Patent Application No. 2002-141789 filed on May 16, 2002, incorporated herein by reference.

BACKGROUND OF THE INVENTION

1. Field of the Invention

The present invention relates to a-printing press with a sheet-turning-over-mechanism for turning over a printing sheet, enabling the printing press to be selectively operable in a one-sided printing mode and a double-sided printing mode, and, in particular relates to a printing press with a sheet-turning-over-mechanism that is capable of properly dealing with a failure occurred during a mode switching operation for switching from the one-sided printing mode to the double-sided printing mode or vice versa.

2. Description of the Background Art

Conventionally, along with diversified printing needs, printing presses with the sheet-turning-over-mechanism selectively operable in the one-sided printing mode and the double-sided printing mode have been known.

In such a printing press with the sheet-turning-over-mechanism, where a failure has been detected by a detection switch or a sensor during the operator carries out the mode switching operation for example from the one-sided printing mode to the double-sided printing mode, a safety switch is activated upon the detected information to stop the entire operation of the printing press to stop the mode switching operation. Thus, it is possible to secure the safety of human bodies during the operator carries out the mode switching operation and prevent machine damages.

The printing press can be forcibly or manually stopped by, for example, pressing a stop button by the operator during the mode switching operation, thereby enabling securing the safety of human bodies and preventing machine damages.

Thus, in order to secure the safety of human bodies or to prevent machine damages, the entire operation of the printing press and hence the mode switching operation are stopped by the manual operation by the operator (pressing the stop button) or by the automatic activation of the safety switch. The detection of any failure by the detection switch or sensor represents the presence of a failure in the sheet-turning-over-mechanism. Accordingly, the mode switching operation needs to be stopped since the continuous mode switching operation might cause a damage or breakdown of the printing press.

In order to suspend the mode switching operation, it is necessary to stop the entire operation of the printing press, which may result in troubles not only in a sheet transferring operation, but also the entire operation of the printing press after restarting the printing press. Moreover, when the entire printing press is to be suspended for some reasons in the course of fine adjustment in some step, such fine adjustment is inevitably suspended. As a result, an adjustment error may be caused in an operation after restarting the printing press, so that it is difficult to resume the operation with precise adjustment. Therefore, in the case when the operation is finished with poor adjustment, such poor adjustment might cause a failure in sheet transferring operation.

Moreover, as described above, where, during the mode switching operation, the entire operation of the printing press has been stopped by manually pressing the stop button by the operator, the automatic activation of the safety switch upon detecting a failure by the detection switch or sensor, or a power failure, the operator needs to recover the printing press to a normal operable state by fixing such a failure by using tools.

However, in a printing press with such a full automatic sheet-turning-over-mechanism, the aforesaid fixing and recovering operation requires special skills which may not be possessed by an operator. If an erroneous fixing and recovering operation is carried out by the operator with no such special skills, damages might be caused in the printing press. For this reason, the operator usually does not carry out a manual recovering operation and, instead, calls a service person with such special skills. As a result, the printing press cannot be operated until the service person has arrived at a customer having the printing press, and fixed the failure and recovered the printing press to a normal operable state. Consequently, once such an unusual situation occurs, the printing press must be stopped with the mode switching operation suspended, leading to significantly lowered productivity of printing operation.

In order to solve these problems, for example, Japanese Patent Publication No. 2878801 discloses a safety device for a sheet-fed printing press with a sheet-turning-over-mechanism, which is designed to retain the information representative of a state of the mode switching operation at the moment of the stop of the printing press. According to this prior-art technique, a keep relay provided in this printing press retains, based upon the function of a stepping relay, the information as to which state of the mode switching operation proceeded. At the same time, a main motor of the printing press is electrically interlocked so as to be held in a stop state during the mode switching operation, based upon contact points of the keep relay. Accordingly, even when the power-supply is turned off for any reason during the mode switching operation, a step at the moment of this turning-off is retained in the keep relay, enabling the printing press to be restarted from an uncompleted step or reproduce a state immediately before the turning-off of the power-supply by again turning on the power supply. As a result, the printing press is less likely to fail in a proper start from the step to be resumed. Also, it is possible to ensure safety in the mode switching operation since the main motor is held in the interlocked state even when the power-supply has been again turned on.

However, in the prior art technique of this type, the keep relay retains the information as to the ongoing mode switching operation on a step basis, with the result that, for example, when the mode switching operation is suspended between steps, it is not possible to precisely retain a state at the moment of the suspension of the mode switching operation. As a result, it is difficult to resume the mode switching operation from the suspended state, even if the operator has restored the printing press to a normal operable state.

Also, where the sensor or switch for detecting a failure of the mode switching operation did not operate properly and hence the printing press has been stopped during the mode switching operation, there is a possibility that the mode switching operation cannot be resumed even after the recovering operation. In this case, it is necessary to perform an operation for having the printing press operable in a one-sided printing mode or double-sided printing mode. Since this operation is manually done, the workload for the operator is increased.

In either case, there is a problem to take a time and involves a troublesome work for recovering the printing press to a normal operable state from a state with the mode switching operation suspended.

SUMMARY OF THE INVENTION

The present invention has been conceived in order to solve the aforesaid problems. It is an object of the present invention to provide a printing press with a sheet-turning-over-mechanism that is capable of easily recovering from its state with the mode switching operation suspended and properly or precisely resuming the mode switching operation based upon the detailed or accurate information.

According to one aspect of the present invention, there is provided a printing press with a sheet-turning-over-mechanism for turning over a printing sheet, enabling the printing press to be selectively operable in a one-sided printing mode and a double-sided printing mode. The printing press includes a controller which, when any failure stops any one of steps of a mode switching operation for switching the printing press from the one-sided printing mode to the double-sided printing mode or vice versa, stores the information representative of a state of the mode switching operation at the moment of the stop due to the failure, and when a normal operable state is restored from the failure, resumes the mode switching operation from a step of the mode switching operation indicated by the operational state stored therein.

With the printing press having the above arrangement, when a failure has stopped any step of the mode switching operation, the controller, which stores the information representative of a state of the mode switching operation at the moment of the stop due to the failure can resume the mode switching operation from a step of the mode switching operation indicated by the operational state stored therein, when a normal operable state is restored from the failure. That is, since a state of the ongoing mode switching operation is continuously or non-stepwisely stored in the controller, an abrupt or unexpected stop of the mode switching operation due to a power failure, an emergency operation of the stop switch by the operator or an activation of the safety switch can be properly dealt, thereby enabling the operational state of the mode switching operation to be precisely stored. Specifically, the mode switching operation can be resumed precisely from its state or step at the moment of the stop of the mode switching operation. As a result, there may cause no trouble with the printing press in resuming the mode switching operation from the step which has been suspended.

The controller preferably includes failure detecting means for detecting a failure in the sheet-turning-over-mechanism during the mode switching operation; operation stopping means for stopping the mode switching operation at the time of the detection of the failure by the failure detecting means; memory means for storing the information representative of a state of the mode switching operation at the time when the mode switching operation has been stopped by the operation stopping means; and operation resuming means which, when the sheet-turning-over-mechanism is restored to a normal operable state, resumes the mode switching operation from a step of the mode switching operation indicated by the operational state read out from the memory means.

According to the above arrangement, when a failure has been detected by the failure detecting means during a mode switching operation, the mode switching operation is stopped by the operation stopping means, while the memory means stores the information representative of a state of the mode switching operation at this time. When a normal operable state is restored from the failure, the operation resuming means reads out the information from the memory means and resumes the operation from a step of the mode switching operation indicated by the operational state. Accordingly, the mode switching operation can be resumed precisely from its state or step at the moment of the stop of the operation, with the result that there may cause no trouble with the printing press in resuming the mode switching operation from the step which has been suspended.

The information representative of the operational state of the mode switching operation preferably includes step numbers respectively allocated to the steps of the mode switching operation.

According to the printing press with the step number included in the information representative of the operational state, the mode switching operation can be resumed from a step corresponding to the step number, which has been suspended due to the stop of the mode switching operation with an improved precision.

According to another aspect of the present invention, there is provided a printing press with a sheet-turning-over-mechanism for turning over a printing sheet, enabling the printing press to be selectively operable in a one-sided printing mode and a double-sided printing mode. The printing press includes a controller which, when any failure stops any one of steps of a mode switching operation for switching the printing press from the one-sided printing mode to the double-sided printing mode or vice versa, stores the information representative of a state of the mode switching operation at the moment of the stop due to the failure, returns the sheet-turning-over-mechanism to a state before the start of a step of the mode switching operation indicated by the operational state stored therein, and resumes the mode switching operation from said step.

With the printing press having the above arrangement, when a failure has stopped any step of the mode switching operation, the controller, which stores the information representative of a state of the mode switching operation at the moment of the stop due to the failure can return the sheet-turning-over-mechanism to a state before the start of a step of the mode switching operation indicated by the operational state stored therein and resume the mode switching operation from said step. Thus, it is not necessary for the operator or service person to manually return the sheet-turning-over-mechanism to a state to be resumed.

According to still another aspect of the present invention, there is provided a printing press with a sheet-turning-over-mechanism for turning over a printing sheet, enabling the printing press to be selectively operable in a one-sided printing mode and a double-sided printing mode. The printing press includes a controller which stores the information representative of a state of the printing press before a mode switching operation for switching the printing press from the one-sided printing mode to the double-sided printing mode or vice versa is started, and when a failure stops any one of steps of the mode switching operation, returns the printing press to the state before the mode switching operation is started.

With the printing press having the above arrangement, the controller stores the information representative of a state of the printing press before the controller starts the mode switching operation, and returns the printing press to the state before the mode switching operation is started. Accordingly, where the mode switching operation cannot proceed, the printing press is returned to a state enabling a first side printing operation if it is the operation completed just before the stop of the mode switching operation. Likewise, the printing press is returned to an operable state enabling a second side printing operation if it is the operation completed just before the stop of the mode switching operation. As a result, the printing press can perform either the first side printing operation or the second side printing operation. Here, the first side printing operation means the operation in which a first side of each sheet is printed in the upstream side of the sheet-turning-over-mechanism, while the second side printing operation means the operation in which a second side of each sheet is printed in the downstream side of the sheet-turning-over-mechanism.

DESCRIPTION OF THE PREFERRED EMBODIMENTS

Referring to accompanying drawings, the following description will discuss embodiments of the present invention.

Figure 1:
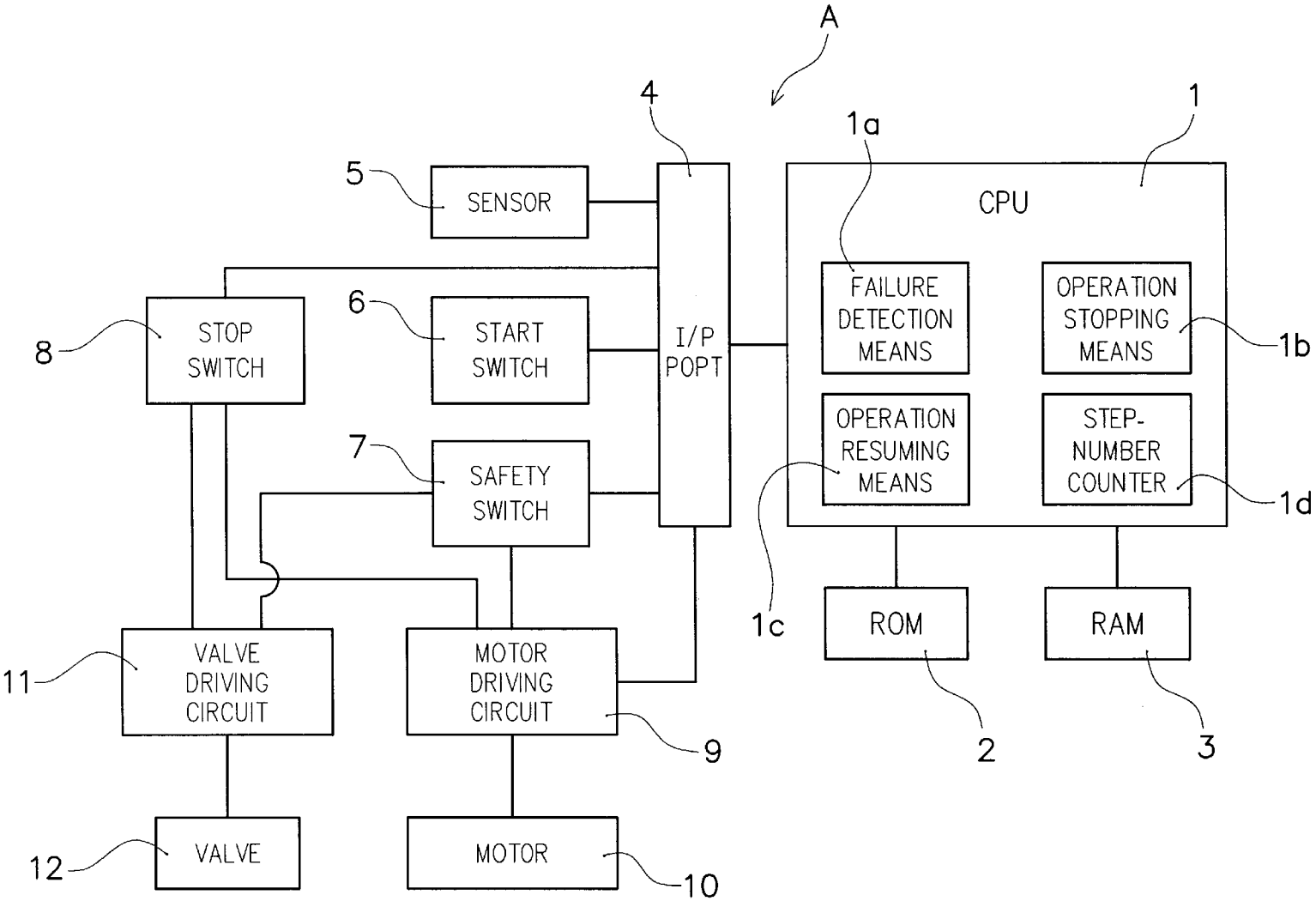
FIG. 1 is a block diagram showing an arrangement of a controller that is provided in a printing press with a sheet-turning-over-mechanism according to one embodiment of the present invention.
Figure 6:
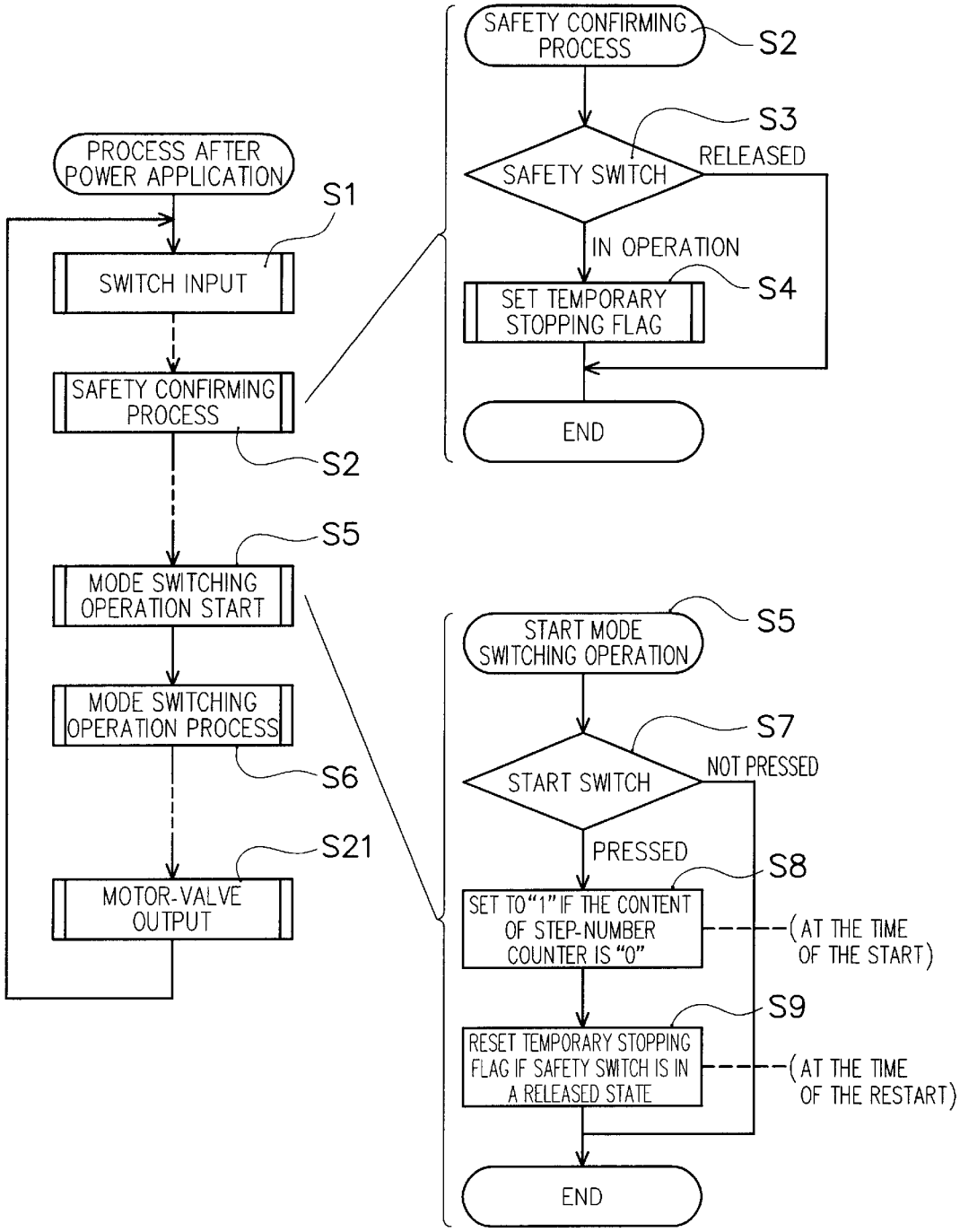
FIG. 6 is a flow chart showing the operational steps of a CPU for processing the mode switching operation for switching the operational mode of the sheet-turning-over-mechanism.
Figure 7:
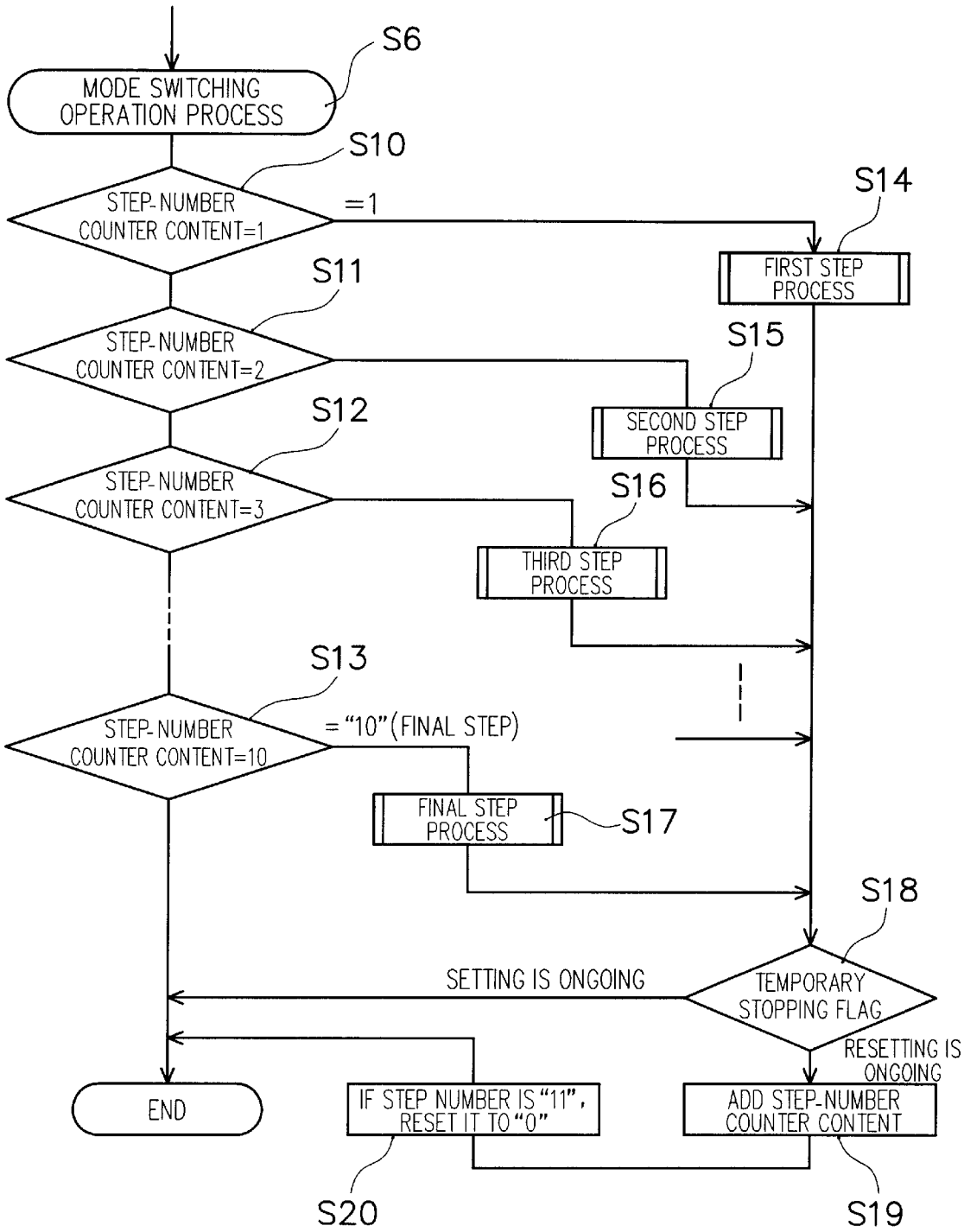
FIG. 7 is a flow chart showing the operation steps of a CPU for processing the operation of the sheet-turning-over-mechanism.
Figure 8:
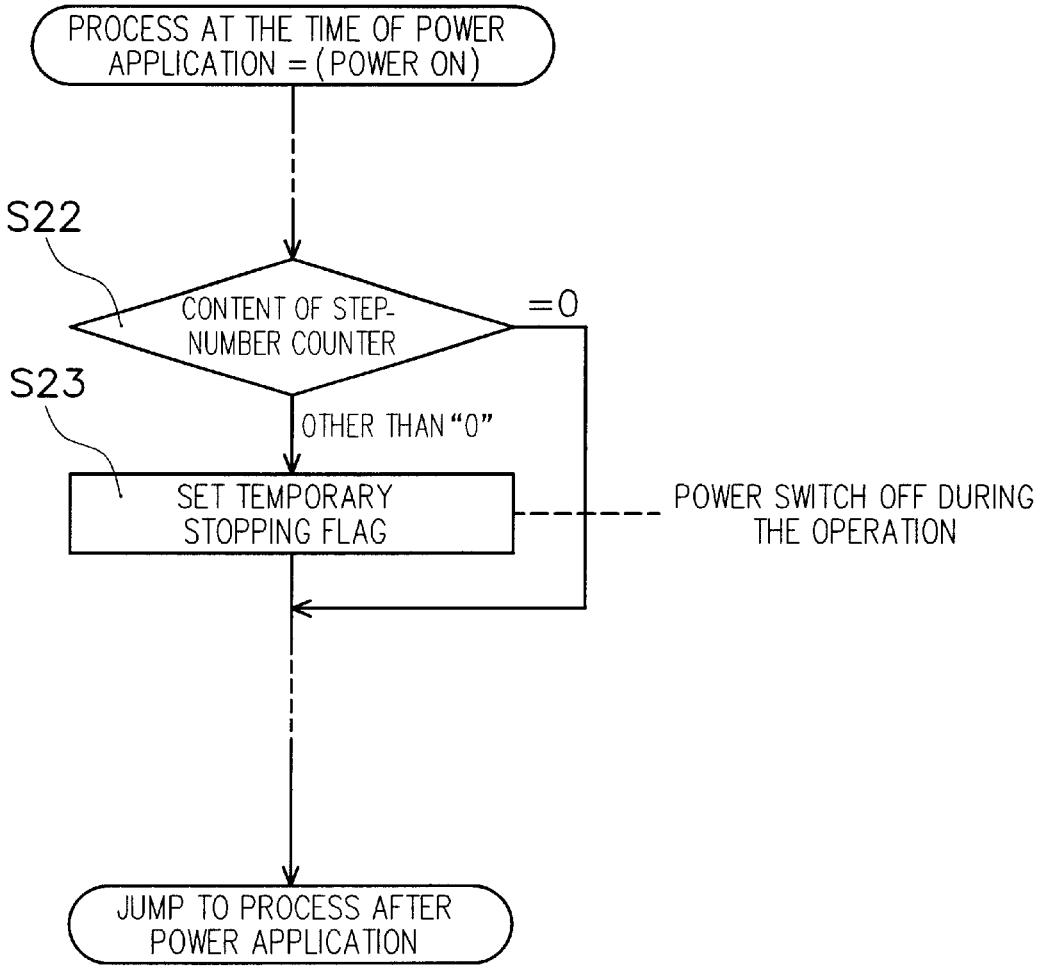
FIG. 8 is a flow chart showing the operational steps of the CPU for dealing with a power failure of the printing press.

FIG. 1 is a block diagram showing an arrangement of a controller that is provided in a printing press with a sheet-turning-over-mechanism according to one embodiment of the present invention. As shown in FIG. 1, a controller A includes a CPU 1 for processing and controlling the entire operation of the printing press; a ROM 2 for storing in advance data and programs required for the operations (calculations and controls) of the CPU 1; a RAM 3 for temporarily storing data required for various operations of the CPU 1; and an I/O port 4 for data transport with respect to the outside element. In particular, the RAM 3 serves as a memory means which can also store the information representative of various states such as a state of the mode switching operation at the moment of its suspension due to a failure, a state of an ongoing printing operation and the like. Moreover, the ROM 2 stores programs or the like in advance for the steps as shown in FIGS. 6 to 8.

The controller A also includes a sensor 5 for detecting a state of the sheet-turning-over-mechanism of the printing press; a start switch 6 for starting the mode switching operation of the printing press; a safety switch 7 for automatically stopping the mode switching operation in the event of a failure; a stop switch 8 for manually stopping the mode switching operation by the operator in the event of a failure; a motor driving circuit 9 for driving a motor 10 for rotating cylinders (that is, various cylinders of the printing press which will be described later) of the printing press; and a valve driving circuit 11 for driving a valve 12 for enabling printing sheets to be sucked on the cylinders in the mode switching operation.

The aforesaid CPU 1 includes a failure detecting means 1*a* for detecting a failure of the mode switching operation based upon outputs of the sensor 5; an operation stopping means 1*b* for stopping the mode switching operation upon detecting a failure by the failure detecting means 1*a*; a step-number counter 1*d* serving as a memory means for storing step numbers(equivalent to information as to a state of an ongoing operation) respectively allocated to a series of steps constituting the mode switching operation; and an operation resuming means 1*c* which, when any unusual state has been restored to a normal operable state, resumes the mode switching operation based upon the step number read out from the step-number counter 1*d* and/or the information representative of various operational states relating to the mode switching operation read out from the RAM 3.

Figure 2:
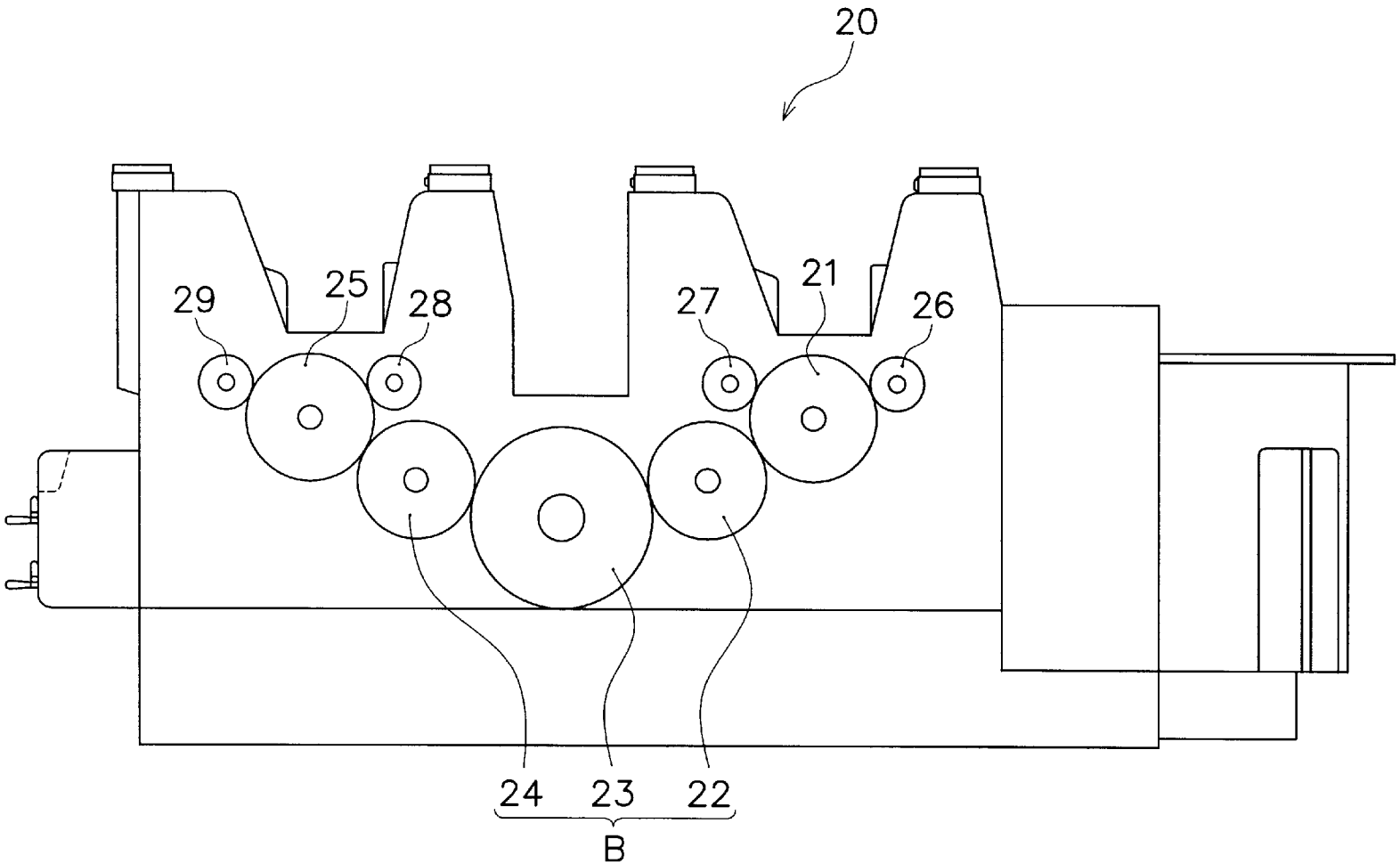
FIG. 2 is a schematic structural view of the printing press with the sheet-turning-over-mechanism.

FIG. 2 is a schematic structural view of the printing press with the sheet-turning-over-mechanism. In FIG. 2, a printing press 20 includes an impression cylinder 21 with its circumferential surface in contact with blanket cylinders 26, 27; an impression cylinder 25 with its circumferential surface in contact with blanket cylinders 28, 29; a delivery cylinder 22 with its circumferential surface in contact with the impression cylinder 21; a turn-over cylinder 24 with its circumferential surface in contact with the impression cylinder 25; and a storage cylinder 23 that is placed between the delivery cylinder 22 and the turn-over cylinder 24 with its circumferential surface in contact with these cylinders. The delivery cylinder 22, the storage cylinder 23 and the turn-over cylinder 24 together constitute a sheet-turning-over-mechanism B. Here, since FIG. 2 is an explanation view for explaining a relative position of the sheet-turning-over-mechanism B to the other elements, rollers and other parts are omitted from this Figure.

Figure 3:
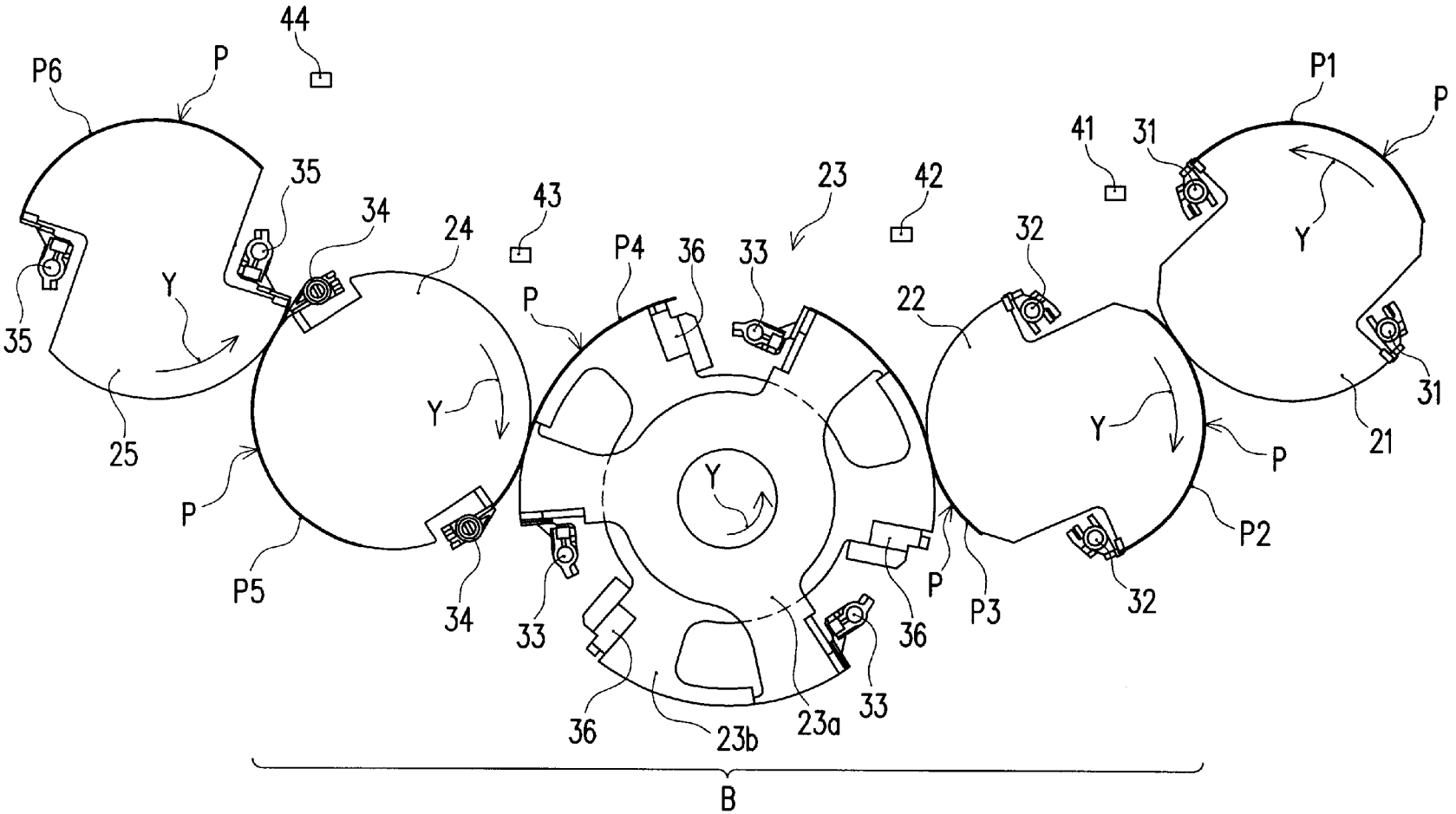
FIG. 3 is a structural view showing the sheet-turning-over-mechanism operated in the one-sided printing mode.
Figure 4:
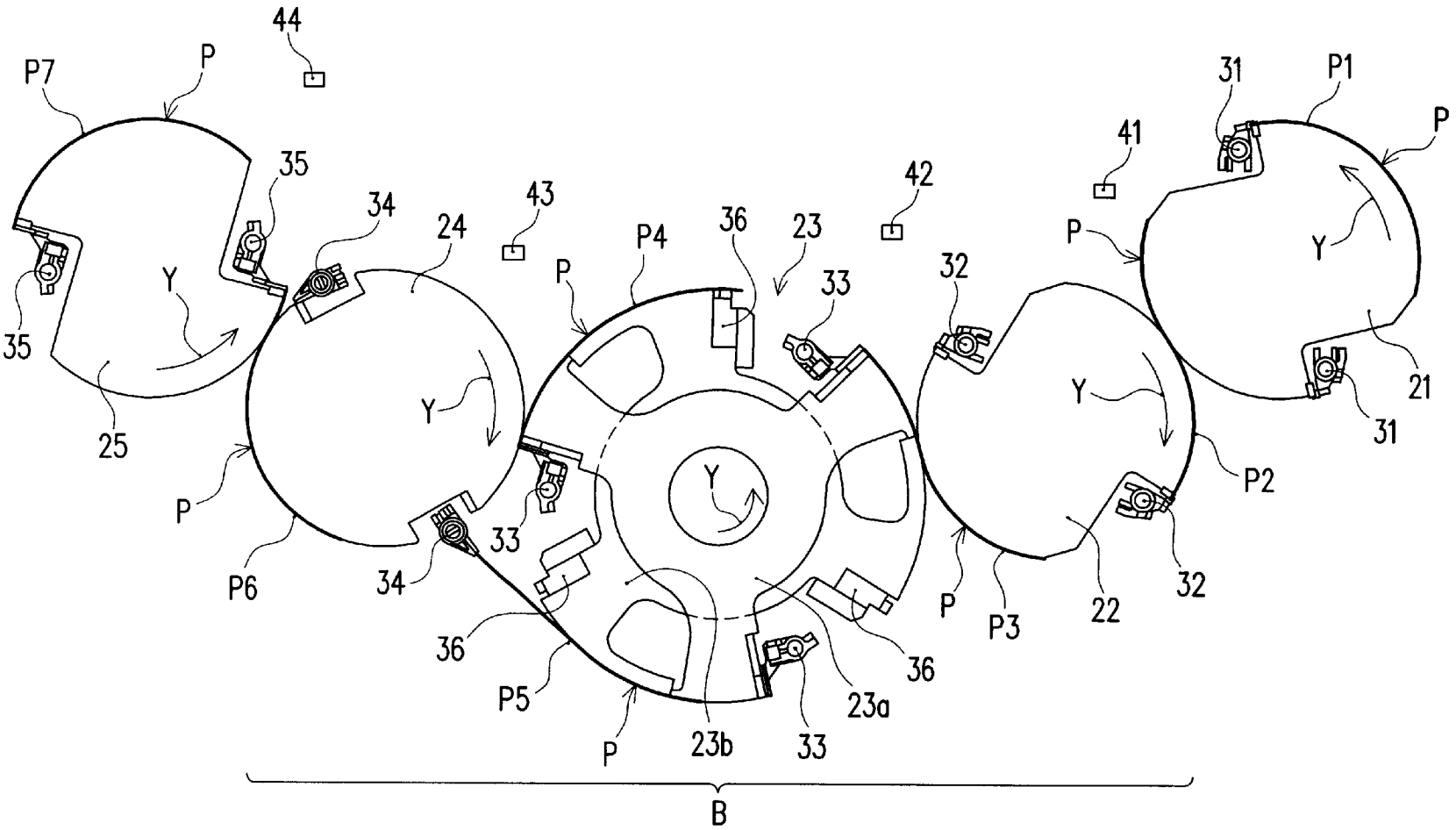
FIG. 4 is a structural view showing the sheet-turning-over-mechanism operated in the double-sided printing mode.
Figure 5:
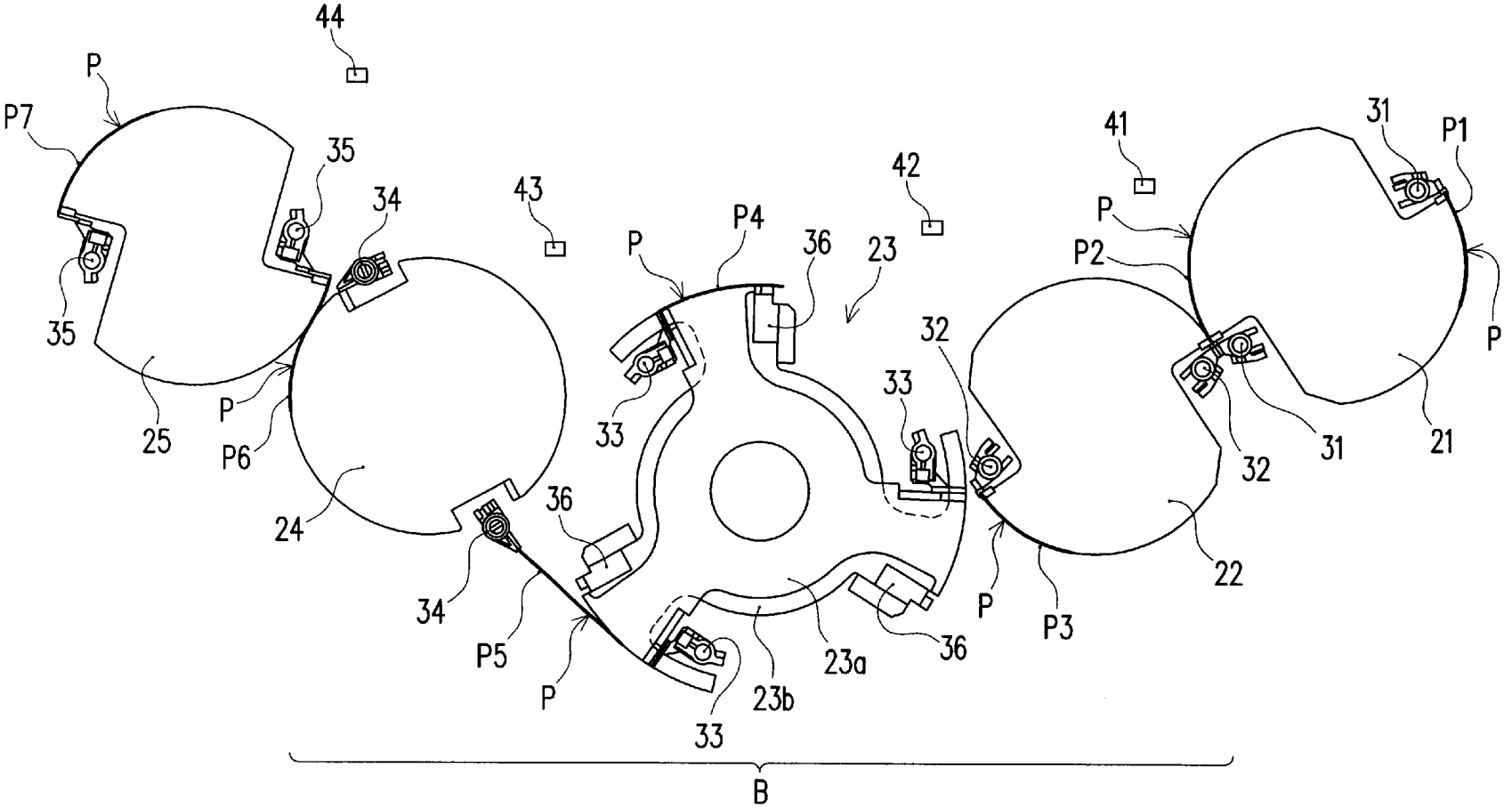
FIG. 5 is a structural drawing showing the sheet-turning-over-mechanism operated in the double-sided printing mode.

FIGS. 3, 4 and 5 are structural views that show the sheet-turning-over-mechanism of the printing press according to one embodiment of the present invention in which corresponding or identical elements to those of FIG. 2 have been given the same reference characters to omit a detailed description thereof. In FIGS. 3, 4 and 5, two grippers 31 are respectively placed in the outer circumferential cutout portions in the impression cylinder 21, while two grippers 32 are respectively placed in the outer circumferential cutout portions in the delivery cylinder 22. In the storage cylinder 23, three grippers 33 are respectively placed in its outer circumferential cutout portions, while three suction heads 36 are respectively placed forward in the rotation direction by a predetermined angle from the respective grippers 33. Moreover, front segment 23*a* and rear segment 23*b*, which are adjustable in a relative positioning to be matched with the size of the printing sheet, are respectively attached to the storage cylinder 23 in a coaxial manner. Two grippers 34 are respectively placed in the outer circumferential cutout portions in the turn-over cylinder 24, while two grippers 35 are placed in the outer circumferential cutout portions in the impression cylinder 25. Sensors 41, 42, 43 and 44 (corresponding to sensor 5 in FIG. 1) for detecting a failure in transporting printing sheets, disorder of the printing press and the like are placed at predetermined positions on the periphery of the sheet-turning-over-mechanism B.

Referring to FIG. 3, the following description will discuss a transporting path of printing sheets in the one-sided printing mode. With the impression cylinder 21, the delivery cylinder 22, the storage cylinder 23, the turn-over cylinder 24 and the impression cylinder 25 rotating in the direction of arrow Y, printing sheets P each are successively transported through P1 on the impression cylinder 21, P2 on the impression cylinder 21 and the delivery cylinder 22, P3 on the delivery cylinder 22 and the storage cylinder 23, P4 on the storage cylinder 23 and the turn-over cylinder 24, P5 on the turn-over cylinder 24 and P6 on the impression cylinder 25 to have one side printed.

Referring to FIG. 4, the following description will discuss a transporting path of printing sheets in the double-sided printing mode. With the impression cylinder 21, the delivery cylinder 22, the storage cylinder 23, the turn-over cylinder 24 and the impression cylinder 25 rotating in the direction of arrow Y, the printing sheets P each are successively transported through P1 on the impression cylinder 21, P2 on the impression cylinder 21 and the delivery cylinder 22, P3 on the delivery cylinder 22 and the storage cylinder 23, P4 on the storage cylinder 23 and the turn-over cylinder 24, P5 on the storage cylinder 23, P6 on the turn-over cylinder 24 and P7 on the impression cylinder 25 to have double sides printed. Here, it is to be noted that when printing sheets P each are transported from P4 on the storage cylinder 23 to P5, prior to arrival at P5, the tail end of each printing sheet P is gripped by the gripper 34 of the turn-over cylinder 24, and this is then transported to P6 on the turn-over cylinder 24. Therefore, when transported on the turn-over cylinder 24, the printing sheet P is placed upside down. Thus, the printing sheets each have double sides printed.

FIG. 5 explains a transporting path of printing sheets having a minimum printable size. The front segment 23*a* and the rear segment 23*b* of the storage cylinder 23 set at positions as shown in FIG. 4 are rotated to adjust their relative positioning, prior to the printing operation, thereby enabling the printing sheet to be fitted in size or length to P4 on the storage cylinder 23, as shown in FIG. 5. Upon completion of these adjustments, the printing operation is started. Subsequently, the printing sheet P located at position P1 on the impression cylinder 21 is shifted through P2, P3, P4, P5, P6 and P7, thereby having double sides printed.

The mode switching operation from the one-sided printing mode to the double-sided printing mode or vice versa involves various adjustments such as phase adjustments of the storage cylinder 23 with respect to the turn-over cylinder 24, phase adjustments for adjusting the phase of a cam (not shown) for proper opening and closing timing of grippers 33 to allow the grippers 33 of the storage cylinder 23 to timely grip and release an end of each printing sheet P, and adjustment for adjusting the relative positioning of the suction heads 36 and the grippers 33 according to the size of the printing sheet P.

Referring to FIGS. 6 and 7, the following description will discuss operations of the CPU 1 (FIG. 1) for performing the mode switching operation. Upon applying power to the printing press, the CPU 1 initiates inputting step to various switches so as to ensure the safety of the printing press (step S1), and then confirming step for confirming the safety of the printing press (step S2). In other words, the safety confirming step comprises a determination step for determining the fact as to whether or not a safety switch 7 is in a released state or in operation (step S3). The CPU 1 then performs a starting step (step S5) for starting the mode switching operation, if the safety switch 7 is in the released state (which means that no unusual state exists), or a temporary stopping flag setting step (S4) if the safety switch 7 is in operation, which means that a failure has occurred.

After the above-mentioned safety confirming step, the mode switching operation is started (step S5). In the operation subsequent to pressing the start switch 6 for starting the mode switching operation (step S7), if the content of the step number counter 1*d* in CPU 1 is "0", it is set to "1" (step S8, S10), and if the safety switch 7 is in the released state, the temporary stopping flag is reset (step S9). Through these steps, the mode switching operation is started (step S5), and the mode switching step is started (step S6). Upon completion of a first step (step S14), the content of the step-number counter 1*d* is set to "2" from "1". Thus, the sequence proceeds to a second step (step S15), and upon completion of the second step, the content of the step-number counter 1*d* is set to "3" from "2" (step S12), and the sequence proceeds to a third step (step S16). Upon completion of the third step, the content of the step number counter 1*d* is successively incremented, and the corresponding steps are performed successively, thus completing the final step (step S17) when the content of the step-number counter 1*d* reaches "10" (step S13).

Here, the content of the step-number counter 1*d* is altered in each of the steps S18, S19 and S20. In other words, when the temporary stopping flag is in a reset state, the content of the step-number counter 1*d* is incremented (since the operation is allowed to proceed to the next step only when the safety switch is released, the content of the step-number counter 1*d* is incremented in each step), and if the content (step number) of the step-number counter 1*d* is 11, it is returned to "0". In this case, the content "10"of the step-number counter 1*d* is allocated to the final step; however, the present invention is not limited to this way of step number allocation.

Here, if a failure has occurred in the printing press or the sheet-turning-over-mechanism B during the mode switching operation, the safety switch 7 is activated to stop the motor 10 through the motor driving circuit 9; thus, the entire operation of the printing press is stopped so that the mode switching operation process is suspended. At this moment, the temporary stopping flag is set (step S4). The step number in the mode switching operation at this suspended state is set in the step-number counter 1*d*. The information representative of a state of the mode switching operation, including the respective step-numbers may be stored in the RAM 3.

Next, when, after the unusual state is recovered to a normal operable state, the start switch 6 is turned on with the safety switch 7 released, the CPU 1 resumes the mode switching operation according to the step number stored in the step-number counter 1*d*. For example, where a failure has stopped the printing press during the second step, the content of the step number counter 1*d* is "2". Thus, the operator or service person manually recovers the sheet-turning-over-mechanism B to a state before the start of the second step. The CPU 1 then resumes the operation from the start of the second step upon reading out "2".

According to an alternative way of processing for coping with a failure occurred during the mode switching operation, the step number and the information representative of any other operational state of the sheet-turning-over-mechanism B (e.g., position or operational state of each cylinder) is stored in the RAM 3 as the information representative of a state of the mode switching operation at the time of the suspension so that the CPU 1 reads out this information representative of the operational state at the time of the suspension from the RAM 3 through the operation resuming means 1*c*, and resumes the mode switching operation based upon this information. According to this mode resuming operation, it is possible to resume the mode switching operation from the stopped state with higher precision, as compared with the operation with the sole use of the step number as the basis for resuming the operation. For example, where a failure has occurred and hence the printing press has been stopped during proceeding the second step, the operator recovers the printing press or the sheet-turning-over-mechanism B from unusual state to a normal operable state. Then, the information representative of the operational state of the mode switching operation such as the positions or operational states of the respective cylinders of the sheet-turning-over-mechanism B is read out from the RAM 3 so that the mode switching operation can be resumed from the state at which the second step has been stopped.

The operation control by the CPU is not necessarily limited to that in the printing press with the sheet-turning-over-mechanism B of the above embodiment. A different operation control of the mode switching operation by the CPU will be discussed below with reference to FIGS. 9 to 11, in which FIG. 9 is a flow chart corresponding to FIG. 7 and therefore the same step numbers are given for the corresponding or identical steps to those of FIG. 7.

According to an alternative way of the operation control by the CPU, where a failure has occurred in either step of the mode switching operation, the safety switch 7 is activated to stop the motor 10 via the motor driving circuit 9, thereby stopping the entire operation of the printing press and hence suspending the mode switching operation. The information representative of a state at the moment of this suspension is stored and the printing press is returned to a state before the start of the mode switching operation.

Figure 9:
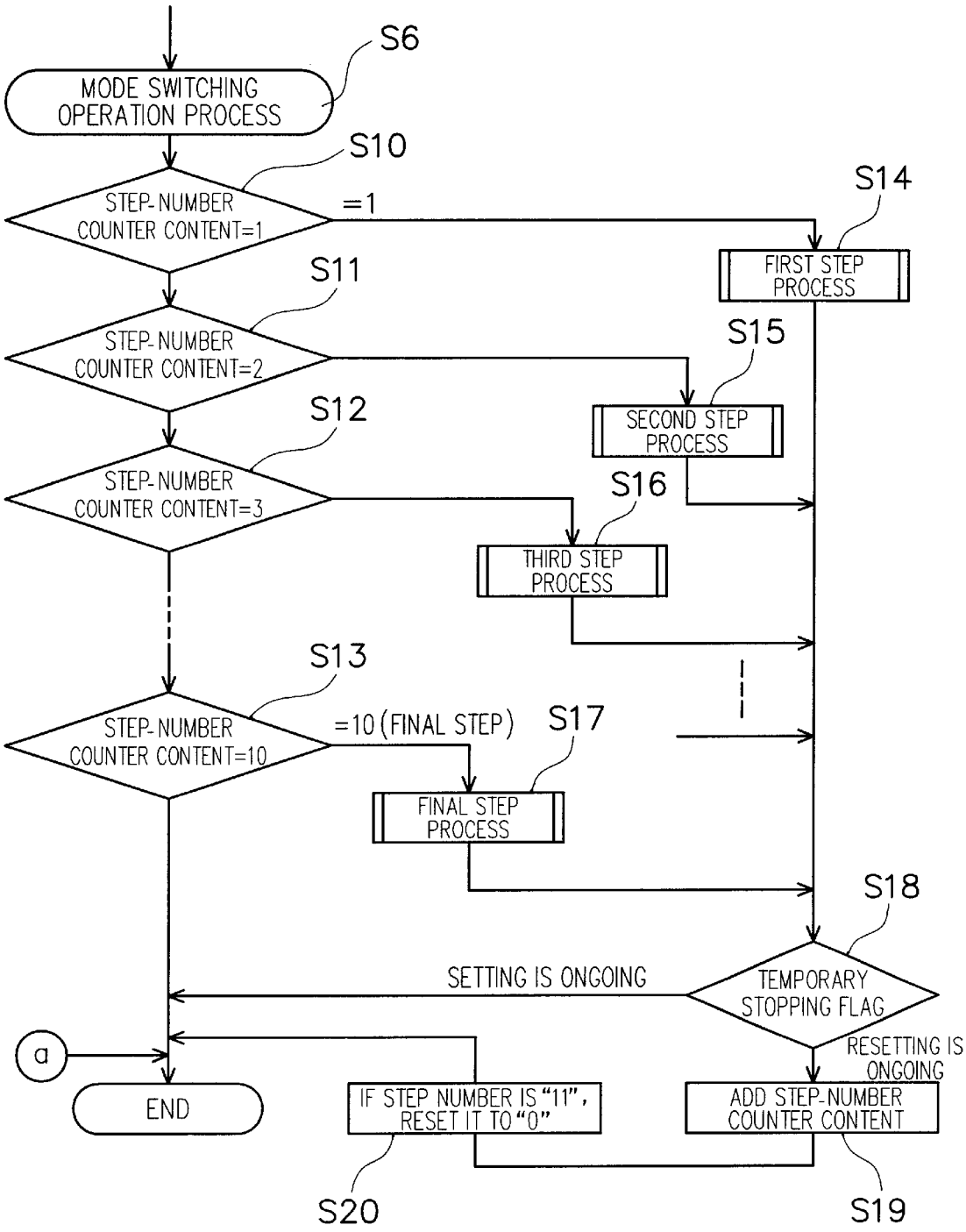
FIG. 9 is a flow chart showing the operational steps of a CPU for processing the operation of the sheet-turning-over-mechanism.
Figure 10:
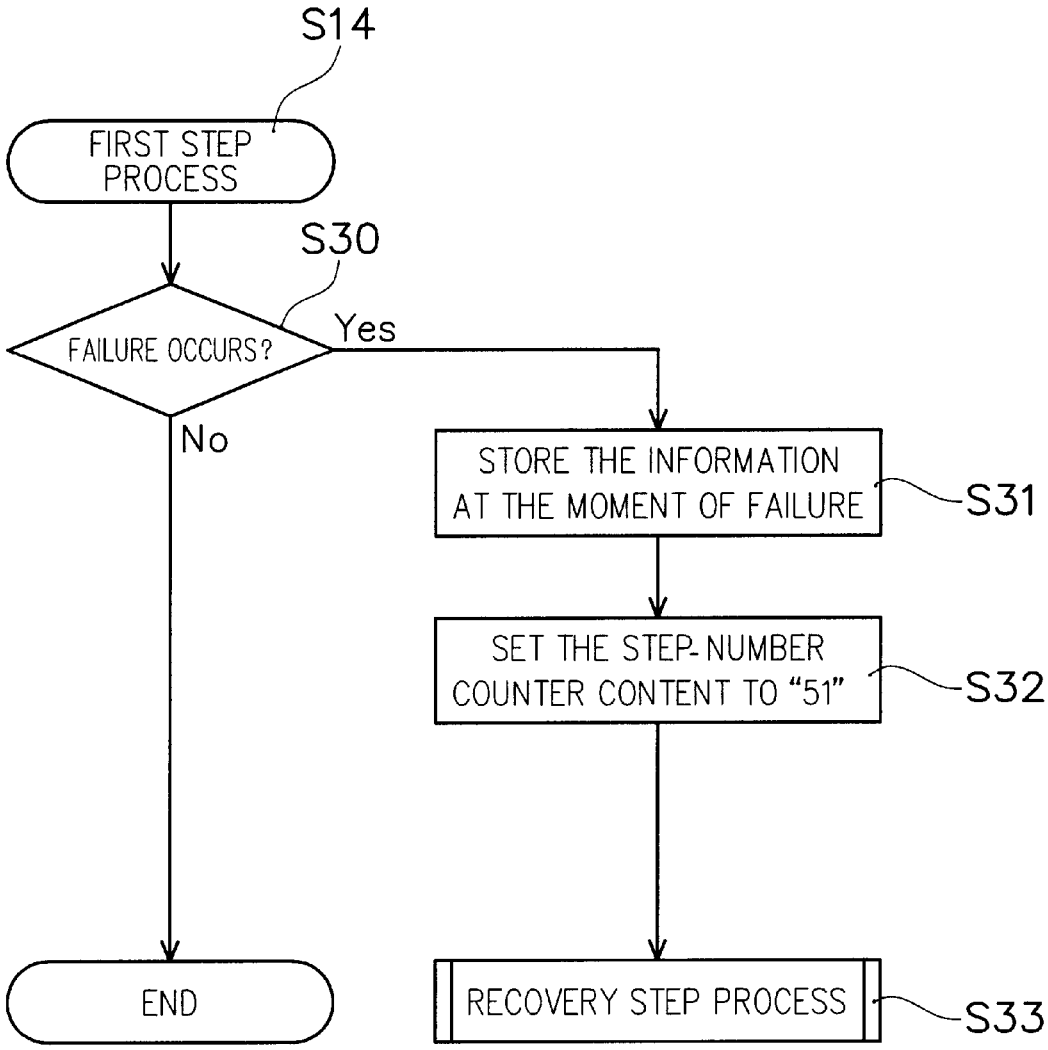
FIG. 10 is a flow chart showing the operational steps of the CPU for processing the first step in FIG. 9.

Specifically, as illustrated in FIG. 9, the mode switching operation is processed so that, when the content of the step-number counter 1*d* is 1 (step S10), the CPU 1 reads out this content and processes the first step (step S14). Subsequent to the completion of the first step, the content of the step-number counter 1*d* is set to 2 (step S11) to start the second step (step S15). After that, the content of the step-number counter 1*d* is successively incremented so that the respective steps are processed. Thus, the CPU 1 processes the respective steps of the mode switching operation according to the content of the step-number counter 1*d*.

Where a failure has been detected (step S30) during processing, for example, the first step (step S14), as illustrated in FIG. 10, the mode switching operation is suspended and the information representative of a state (including the step number) of the mode switching operation at the moment of the suspension is stored in the RAM 3 (step S31). The content of the step-number counter 1*d* is then overwritten with a recovery step number which is previously allocated corresponding to the information representative of each operational state and more specifically to the step number. Specifically, the content of the step-number counter 1*d* is overwritten with "51" (step S32), where a failure has occurred in the first step. Likewise, if the operation is suspended in the second step, the content of the step-number counter 1*d* is overwritten with "52", and "53" if the operation is stopped in the third step. Thus, the step-number counter 1*d* is overwritten with the recovery step number corresponding to the step number stored in the RAM 3 at the time of suspension. The CPU 1 reads out this recovery step number from the step-number counter and initiates processing of the recovery operation to recover the printing press to its operational state before starting the mode switching operation (step S33).

In this embodiment, the mode switching operation is comprised of 10 steps (from an initial step to a final step), which are respectively allocated recovery step numbers from "51" to "60". It is a matter of course that the different numbering may be employed. Although the recovery step number is determined corresponding only to the step number among various operational states stored in the RAM 3 in this embodiment, it may be determined in more detail by simultaneously reading out the information representative of various operational states in the mode switching operation (position or operational state of each cylinder of the sheet-turning-over-mechanism B). This enables the recover operation processing to be more minutely determined, so that the printing press can more precisely be returned to a state before the start of the mode switching operation.

Figure 11:
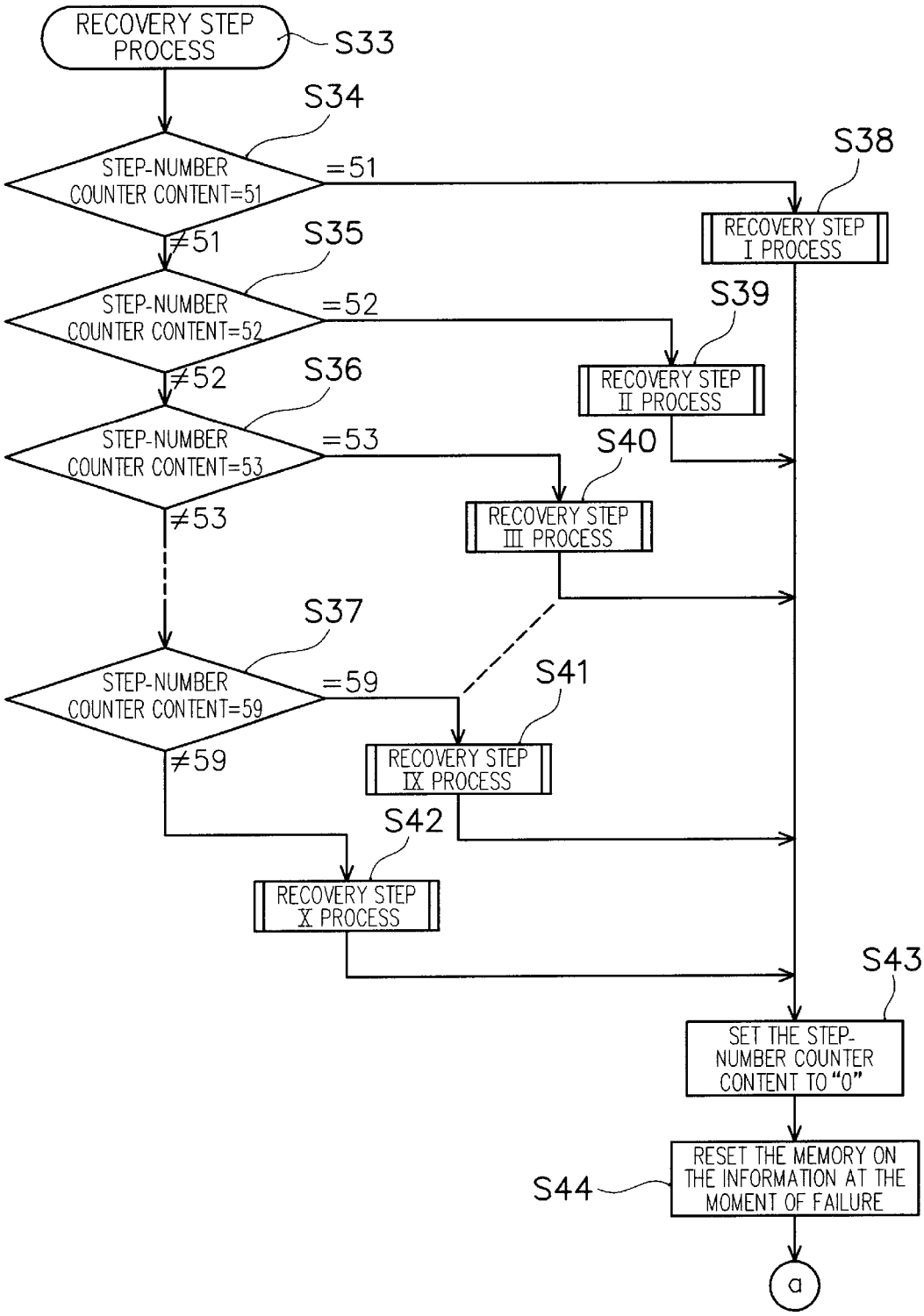
FIG. 11 is a flow chart showing the operational steps of the CPU for processing the recovery step in FIG. 10.

As illustrated in FIG. 11, the CPU 1 performs processing of the recovery operation according to the content of the step-number counter 1*d*, enabling the sheet-turning-over-mechanism B to recover to the state before starting the mode switching operation or starting the first step (step S6). Specifically, the ROM 2 stores the information representative of a state of the printing press before the start of the mode switching operation. If the content of the step-number counter 1*d* is "51" (step S34), the CPU 1 performs a recovery step I (step S38). The recovery step I, which is a step to return the sheet-turning-over-mechanism B to its state before the start of the mode switching operation from the its state at the moment of the suspension, is previously stored in the ROM 2. Where the content of the step-number counter 1*d* is "52" (step S35), the CPU performs a recovery step II (step S39) to return the sheet-turning-over-mechanism B to a state before the start of the mode switching operation from a suspended state in the second step. Likewise, the ROM stores recovery steps, III to X, respectively corresponding to the recovery step numbers, "53" to "60", so that the sheet-turning-over-mechanism B is returned to the state before the start of the mode-switching operation from any one of the third to final steps suspended (see step S36, S37, and S40–S42). After returning the sheet-turning-over-mechanism B to the state before the start of the mode switching operation from a suspended state, the content of the step-number counter is set to "0" (step S43), and the information at the moment of the suspension is deleted from the RAM 3 (step S44), thereby resetting the printing press to the state before the start of the mode switching operation.

Accordingly, even if the mode switching operation has been stopped during processing any step due to a failure in the sheet-turning-over-mechanism B, or the sensor 5 or the safety switch 7, it is possible to return the printing press to a state before the start of the mode switching operation, or a state after it has just printed on sheets. For example, the printing press is returned to a state enabling a first side printing operation if it is the operation completed just before the stop of the mode switching operation. Likewise, the printing press is returned to an operable state enabling a second side printing operation if it is the operation completed just before the stop of the mode switching operation. As a result, the printing press can perform either the first side printing operation or the second side printing operation without the necessity to stop the printing press until fixing of the failure. Where no failure has been finally found in the sheet-turning-over-mechanism B, or the sensor 5 or the safety switch 7 as a result of checking following the stop of the printing press, the mode switching operation is returned to a state before its start and resumed from its initial state, so that the mode switching operation can be finished and a subsequent printing operation can be performed.

In the above operation, the RAM 3 stores the information representative of a state (containing the step number) of the mode switching operation at the moment of the suspension due to a failure, and the CPU 1 performs the return operation of the sheet-turning-over-mechanism B to the state before its start. Accordingly, it is possible to return the printing press to its state capable of printing without the necessity of manual return operation by the operator or service person.

In FIG. 10, when a failure has occurred in the first step, the content of the step-number counter 1*d* is overwritten with "51" (step S32). This recovery step number may be stored in the RAM 3 along with the information representative of a state of the mode switching operation in step S31. That is, the CPU 1 may read out the recovery step number stored in the RAM 3 to initiate the recovery operation. It is a matter of course that residual step numbers can also be stored in the RAM 3.

In this embodiment, a state to which the sheet-turning-over-mechanism B is returned through processing of a corresponding recovery step is limited to the state before the start of the mode switching operation. Alternately, the sheet-turning-over-mechanism B may be returned to a step just before a suspended step. For example, the recovery operation is set so that where the mode switching operation has been suspended in the course of the second step (step S15), the sheet-turning-over-mechanism B is returned to a state before the start of the second step (a state after the finish of the first step (step S14)). In this case, the content of the step-number counter is not set to "0", but a step number stored at the moment of the suspension, that is, "2", so that the mode switching operation can be resumed from the second step. Likewise, where the mode switching operation has been suspended in the course of the third step (step S16), the recovery operation is set so that the mode switching operation can be resumed from the third step. It is a matter of course that various returning operations may be employed without departing the scope of the present invention.

Now, the description will be made for the operational steps of the CPU 1 in the event of a power failure with reference to a flow chart illustrated in FIG. 8. In the event of a power failure during the mode switching operation after any processing subsequent to the power application, when the power supply has been restored or power has been applied again, the sequence proceeds from step S22 to step S23 to set the temporary stopping flag, after the restoration of power supply or reapplication of the power. The step number of the mode switching operation at the moment of the suspension due to this power failure is stored in the step-number counter 1*d*. Here, it is assumed that the information representative of a state (the step number may be contained) is stored in the RAM 3. Then, the start switch 6 is turned on after restoration of the power supply or reapplication of the power to the printing press, the CPU 1 reads out the step number from the step-number counter 1*d* and/or the information representative of any other states from the RAM 3 through the operation of the operation resuming means 1*c*, and resumes the mode switching operation based upon these data.

What is claimed is:

1. A printing press with a sheet-turning-over-mechanism for turning over a printing sheet, enabling the printing press to be selectively operable in a one-sided printing mode and a double-sided printing mode through a mode switching operation, comprising:

a controller including a computing device with a CPU for performing said mode switching operation according to a program executable by said computing device and a memory configured such that, when a failure stops any one of steps of a mode switching operation for switching the printing press from the one-sided printing mode to the double-sided printing mode or vice versa, said memory stores the information representative of a state of the mode switching operation at the moment of the stop due to the failure, and when a normal operable state is restored from the failure, said computing device resumes the mode switching operation from a step of the mode switching operation indicated by the operational state stored in said memory.

2. The printing press with a sheet-turning-over-mechanism according to claim 1, wherein said controller comprises:

failure detecting means for detecting a failure in the a sheet-turning-over-mechanism during the mode switching operation;

operation stopping means for stopping the mode switching operation at the time of the detection of the failure by the failure detecting means;

memory for storing the information representative of a state of the mode switching operation at the time when the mode switching operation has been stopped by the operation stopping means; and operation resuming means which, when the sheet-turning-over-mechanism is restored to a normal operable state, resumes the mode switching operation from a step of the mode switching operation indicated by the operational state read out from the memory.

3. The printing press according to claim 2, wherein the information representative of the operational state includes step numbers respectively assigned to the steps of the mode switching operation.

4. The printing press according to claim 1, wherein the information representative of the operational state includes step numbers respectively assigned to the steps of the mode switching operation.

5. A printing press with a sheet-turning-over-mechanism for turning over a printing sheet, enabling the printing press to be selectively operable in a one-sided printing mode and a double-sided printing mode through a mode switching operation, comprising:

a controller including a computing device with a CPU for performing said mode switching operation according to a program and a memory so that when a failure stops any one of steps of a mode switching operation for switching the printing press from the one-sided printing mode to the double-sided printing mode or vice versa, said memory stores the information representative of a state of the mode switching operation at the moment of the stop due to the failure, and said computing device returns the sheet-turning-over-mechanism to a state before the start of a step of the mode switching operation indicated by the operational state stored in said memory and resumes the mode switching operation from said step.

6. A printing press with a sheet-turning-over-mechanism for turning over a printing sheet, enabling the printing press to be selectively operable in a one-sided printing mode and a double-sided printing mode through a mode switching operation, comprising:

a controller including a computing device with a CPU for performing said mode switching operation-according to-a program and a memory -for storing the information representative of a state of the printing press before a mode switching operation for switching the printing press from the one-sided printing mode to the double-sided printing mode or vice versa is started, in which when a failure stops any one of steps of the mode switching operation, said computing device returns the printing press to the state before the mode switching operation is started, said state being stored in said memory.

7. A method for improving the operation of a printing press, said printing press including a control system and capable of operating in a one-sided printing mode and a double-sided printing mode, said control system including a memory and a computing device capable of performing a mode-switching operation between said one-sided and said double-sided modes, including the steps of:

detecting a failure in a particular step in a series of steps in said mode-switching operation, wherein said failure stops said particular step;

automatically storing information representative of a state of said mode switching operation at the moment of said failure in said memory; and resuming said mode switching operation in said series of steps after restoring a normal operable state by recalling said information representative of a state.

* * * * *